US006128867A

United States Patent [19]

MacKarvich

[11] Patent Number: 6,128,867

[45] Date of Patent: Oct. 10, 2000

[54] GROUND ANCHOR WITH STABILIZER CAP

[76] Inventor: Charles J. MacKarvich, 3940 Paces Manor Dr., Atlanta, Ga. 30339

[21] Appl. No.: 09/404,674

[22] Filed: Sep. 23, 1999

[51] Int. Cl.[7] ..... E02D 5/74

[52] U.S. Cl. ..... 52/157; 52/157; 52/155; 52/161

[58] Field of Search ..... 52/157, 155, 161

[56] References Cited

U.S. PATENT DOCUMENTS

| | | | |
|---|---|---|---|
| 204,246 | 5/1878 | Pierce . | |
| 284,219 | 9/1883 | Mehew . | |
| D. 287,098 | 12/1986 | Wilson et al. | D8/388 |
| D. 287,460 | 12/1986 | MacKarvich | D8/388 |
| 839,822 | 1/1907 | Dunnington . | |
| 2,569,528 | 10/1951 | Kandle . | |
| 3,645,055 | 2/1972 | Roza | 52/157 |
| 3,848,367 | 11/1974 | Barnes | 52/157 |
| 3,952,523 | 4/1976 | Gale | 61/39 |
| 4,310,090 | 1/1982 | MacKarvich | 206/443 |
| 4,492,493 | 1/1985 | Webb | 405/172 |
| 4,593,872 | 6/1986 | Svensson | 248/156 |
| 4,803,812 | 2/1989 | Alexander, Sr. | 52/157 |
| 4,863,137 | 9/1989 | Cockman et al. | 248/545 |
| 4,923,165 | 5/1990 | Cockman | 52/157 |
| 4,928,446 | 5/1990 | Alexander, Sr. | 52/98 |
| 5,066,168 | 11/1991 | Holdeman | 405/249 |
| 5,797,226 | 8/1998 | MacKarvich | 52/155 |

*Primary Examiner*—Carl D. Friedman
*Assistant Examiner*—Christy M. Syres
*Attorney, Agent, or Firm*—Thomas, Kayden, Horstemeyer & Risley

[57] ABSTRACT

A ground anchor 20 with stabilizer cap 26 secures above ground objects, such as premanufactured buildings 50, during storms, high winds or ground tremors. The ground anchor has an anchor shaft 22 which is inserted into the ground and at least one auger blade 24 attached to the lower end of the anchor shaft. The auger blade engages the ground and forcibly draws the anchor shaft downwardly into the ground as the anchor shaft is rotated by an installation driver. The circular stabilizer cap 26, having a diameter greater than the auger blade, is mounted concentric to and normal to the upper end of the anchor shaft. Rigidly attached to the stabilizer cap is a skirt 30. The skirt rotates in unison with the anchor shaft, and engages and enters into the undisturbed ground outside the hole made in the ground by the auger blade. A tie down strap 62 connects a winch mount 36, attached to the top of the stabilizer cap, to the premanufactured building. As the tie down strap is tensioned and exerts lateral forces against the ground anchor, lateral support to the ground anchor is provided by the stabilizer cap skirt which is firmly embedded in the undisturbed soil.

5 Claims, 5 Drawing Sheets

GROUND ANCHOR WITH STABILIZER CAP

FIELD OF THE INVENTION

This invention relates generally to ground anchors and the like which are used to secure above ground objects, such as premanufactured buildings or trailers, to the ground.

BACKGROUND OF THE INVENTION

Ground anchoring devices are used to secure above ground objects, such as premanufactured buildings, premanufactured homes, trailers, greenhouses and the like. Ground anchors protect and stabilize the buildings during adverse weather conditions, such as heavy winds, or ground tremors. For example, premanufactured buildings typically are mounted on a pair of parallel I-beams and ground anchors are positioned adjacent the side of the structure and tension straps extended at a slope upwardly from the around anchors to the I-beam. A ground anchor of this type is taught in U.S. Pat. No. 4,310,090.

As illustrated in FIG. 1 of the patent, ground anchors typically include an anchor shaft having a lower end for insertion into the ground and an upper end for positioning above the ground, at least one helically shaped auger blade fixedly attached to the lower end of the shaft and a winch mount fixedly attached to the upper end of the shaft. During installation, the anchor shaft is rotated in a direction in which the auger blades penetrate the ground and forcibly drive the anchor shaft in a downward direction. Often, the rotation of the anchor shaft is effected by a power driven installation driver such as a gas or electric motor. The installation driver is releasably coupled to the winch mount at the upper end of the anchor shaft.

The ground anchor is secured to the I-beams of the premanufactured building by a connecting member such as tie down strap, band, chain, belt or the like. Hereinafter, description of the prior art will refer to a tie down strap for securing a premanufactured building, however the description of prior art equally applies to other securing members and/or other ground objects. One end of the tie down strap is connected to the premanufactured building, such as with a U-shaped connector clip which attaches to an I-beam on which the premanufactured building is mounted. The other end of the tie down strap typically connects to a winch positioned in the winch mount at the upper end of the ground anchor. The tensioned tie down strap applies a downward sloped force to the premanufactured building, thereby resisting lateral and upward movement of the premanufactured building which may be caused by winds or ground tremors.

Ground anchors usually are installed after the premanufactured building has been placed at its permanent location. Because of the installation driver operating clearances, ground anchors usually are installed in a vertical position offset from the edge of the premanufactured building. Once the tie down strap has been connected between the ground anchor and the premanufactured building, the tie down strap is tightened to a desired tension. Because of both vertical and horizontal offset of the ground anchor from the I-beam of the premanufactured building, tension forces exerted by the tie down strap on the ground anchor have both vertical and horizontal force components. Vertical forces which tend to pull the ground anchor upwardly are resisted by the forces exerted by the auger blades embedded in the soil.

However, the prior art ground anchor alone can not effectively resist the lateral forces exerted by the tensioned tie down strap. As the ground anchor is driven into the ground by the installation driver, the auger blades engage and cut into the soil to draw the anchor shaft down into the ground. As the auger blades cut through the soil, a hole is formed and is filled with a column of disturbed soil. This disturbed soil, which is loose and easily moved about, can not provide significant resistance to lateral forces exerted on the anchor shaft. The demarcation between the column of disturbed soil and the undisturbed soil is the anchor hole side wall. As the tie down strap is tightened, the top of the anchor shaft is pulled sideways through the loose dirt until the shaft engages a solid structure, such as the anchor hole side wall or some additional restraining element.

Often, this additional restraining element may be a stabilizer plate pounded down into the ground adjacent the anchor shaft in a position between the anchor shaft and the premanufactured building. The stabilizer plate typically is made of a single steel plate, or of a similar material, approximately one foot wide having a bottom portion sufficiently deep so that the bottom portion can be firmly embedded in the soil. The ground anchor is first rotated and drawn partially into the ground by the auger blades. Next, the stabilizer plate, which is not a part of the anchor, is placed in abutment with the anchor shaft and pounded into the ground. Then, rotation of the anchor is resumed until the winch mount at the upper end of the shaft rests near the upper edge of the stabilizer plate.

After installation of the ground anchor and the stabilizer plate, a tie down strap is attached to the winch mount and the premanufactured building. The tie down strap is winched tight to a desired tension. As the tie down strap is tensioned the anchor shaft bends or flexes as the anchor shaft upper end is pulled laterally by the tension strap toward the stabilizer plate. Once the ground anchor shaft engages the stabilizer plate, lateral movement of the top end of the anchor shaft is stopped and the tie down strap can be tightened to the desired tension. The stabilizer plate provides a much broader bearing surface against the ground, so that the lateral forces applied by the ground anchor to the stabilizer plate are spread over a much larger cross-sectional area. This provides the ground anchor with substantially increased lateral strength.

Several problems and difficulties are encountered with the prior art as described. Installation of the stabilizer plate increases the installation time and adds cost. The stabilizer plate is manually driven into the ground by the installer, usually by striking or pounding the top portion of the stabilizer plate with a sledge hammer or other type of impact tool. If the ground anchor is initially installed too close to the trailer, pounding the stabilizer plate into the ground may be extremely difficult, if not impossible, because the installer would lack sufficient clearance from the premanufactured building for an effective and efficient swing of the sledge hammer. As is well known by one in the art, pounding objects into the ground with a sledge hammer presents a safety risk to the installer. Also, the premanufactured building may be accidentally hit by the sledge hammer, causing damage to the premanufactured building. Thus, a heretofore unaddressed need exists in the industry for a way to provide for an improved ground anchor with a stabilizing device which installs easily, quickly and safely.

Furthermore, to provide sufficient stabilizing support to the anchor shaft, the stabilizer plate should be sufficiently wide to be embedded firmly in the undisturbed soil outside of the hole made by the auger blades when the anchor shaft was rotated down into the ground. Prior art stabilizer plates typically are approximately one foot wide. Also, the stabilizer plate should be pounded into the ground perpendicular to the ground surface and centered under the tie down strap.

However, the stabilizer plate is likely to shift in the ground with each impact of the sledge hammer and will most probably end up in a final position which only approximates the desired perpendicular position. Additionally, other objects around the premanufactured building, such as sidewalks, trees or decorative landscaping, may require a narrow stabilizer plate or may prevent installation of the stabilizer plate in a preferred position. One experienced in the art will realize that if the stabilizer plate is not perpendicular to the surface of the ground, or if the stabilizer plate is not normal to the vertical plane of the tensioned tie down strap, then the resistive force exerted by the stabilizer plate is not maximized because the effective cross-sectional area of the stabilizer plate is not maximized. Thus, a heretofore unaddressed need also exists in the industry for a way to provide for a ground anchor stabilizing device which effectively opposes the horizontal forces created by the tensioned tie down strap independent of the location of the ground anchor, the position of the stabilizer plate and/or the position of the tie down strap.

In the absence of a stabilizer plate or other restraining element, bending or flexing the upper portion of the anchor shaft toward the premanufactured building causes the anchor to depend mostly on its auger blades to resist pulling out from the ground, instead of using both the auger blades and the stabilizer plate to resist the pulling forces. The degree of anchor shaft bending or flexing depends upon the soil conditions, less bending with hard soils and more bending with soft soils. If a stabilizer plate is employed, there may be less bending of the anchor shaft as the anchor shaft is pulled into engagement with the stabilizer plate, depending upon the positioning of the stabilizer plate. However, a heretofore unaddressed need exists in the industry for a way to provide for a ground anchor stabilizing device which substantially reduces the bending or flexing of the upper end of the anchor shaft.

In the absence of a stabilizer plate or other restraining element, the top portion of the side wall of the hole made in the ground by the auger blades of the ground anchor when installed in the ground would likely be damaged when the anchor shaft engages the side wall as the tie down strap is tightened. If the side wall is not permanently stabilized after installation of the ground anchor, the tie down strap will eventually loosen as the side wall is further damaged by the constant force exerted by the anchor shaft or by subsequent erosion of the soil. Alternatively, the side wall of the anchor hole may be damaged when the stabilizer plate is driven into the ground. The strap would loosen if there is any subsequent settling or movement of the stabilizer plate. Thus, a heretofore unaddressed need exists in the industry for a way to provide for an improved ground anchor stabilizing device which provides adequate anchor support in soft or hard soil conditions, and does not damage the soil around the top end of the anchor hole side wall.

SUMMARY OF THE INVENTION

Briefly described, the present invention is a ground anchor with a stabilizer cap for use in anchoring an above ground object, such a premanufactured building. Anchoring secures and stabilizes the premanufactured building during adverse weather conditions, such as high winds, or ground tremors.

The ground anchor with stabilizer cap includes an anchor shaft having a lower end for upright insertion into the ground, an upper end for connecting to a premanufactured building or other above ground object, at least one auger blade attached to the lower end of the anchor shaft wherein the auger blade engages the ground and forcibly draws the anchor shaft downwardly into the ground as the anchor shaft is rotated by an installation driver, and a stabilizer cap.

The approximately circular stabilizer cap is mounted concentric to and normal to the upper end of the anchor shaft. The stabilizer cap has a top portion having an outer edge of greater diameter than the diameter of the auger blades. Attached to the stabilizer cap is a circular skirt approximately the same diameter as the stabilizer cap top portion. The upper annular edge of the skirt is rigidly attached to the outer edge of the stabilizer cap top portion so that the stabilizer cap skirt rotates in unison with the anchor shaft. As the anchor shaft is rotated downwardly into the ground by the installation driver, the skirt eventually engages and enters into the undisturbed ground outside the hole made in the ground by the auger blades.

A winch mount is rigidly connected to the ground anchor above the stabilizer cap for connecting the ground anchor to an above ground object with a tie down strap. As the tie down strap is tensioned and exerts lateral forces against the ground anchor, lateral support to the upper end portion of the anchor shaft is provided by the stabilizer cap skirt which is firmly embedded in the undisturbed soil.

The stabilizer cap may be either disk or domed shaped. Also a series of teeth formed on the bottom of the circular edge of the skirt engage and penetrate the ground as the ground anchor is rotated and drawn into the ground.

The stabilizer cap includes a stacking slot extending through the stabilizer cap. The stacking slot is shaped to receive the anchor shaft of a duplicate ground anchor for stacking the ground anchors in a head-to-toe arrangement for storage and transport.

The diameter of the stabilizer cap is at least approximately twice the diameter of the auger blades, assuring that the bottom edge of the stabilizer skirt will engage the undisturbed ground outside the hole made by the auger blades.

Thus, it is an object of this invention to provide an improved ground anchor which has fewer parts and more effectively and efficiently counter acts lateral forces exerted by the tensioning of the tie down strap.

Another object of the invention is to provide for an improved ground anchor which is more simply installed with fewer steps and at a lower cost.

Another object of the invention is to provide for an improved ground anchor which provides the same measure of lateral support regardless of the direction the tension strap extends from the ground anchor.

Another object of this invention is to provide for an improved ground anchor which can be installed with mininal risk of injury to the installer or damage to the premanufactured building.

Another object of this invention is to provide for an improved ground anchor which reduces the tendency of flexing or bending of the upper portion of the anchor shaft.

Still another object of the invention is to provide an improved unitary ground anchor that includes a stabilizer cap that is moved in unison with the anchor shaft into the ground and provides increased resistance to lateral forces applied to the anchor and which does not require the installation of a separate stabilizer plate to be used to provide lateral support to the anchor.

Other objects, features and advantages of this invention will become apparent upon reading the following specification, when taken in conjunction with the accompanying drawings.

DETAILED DESCRIPTION

Figure 1:
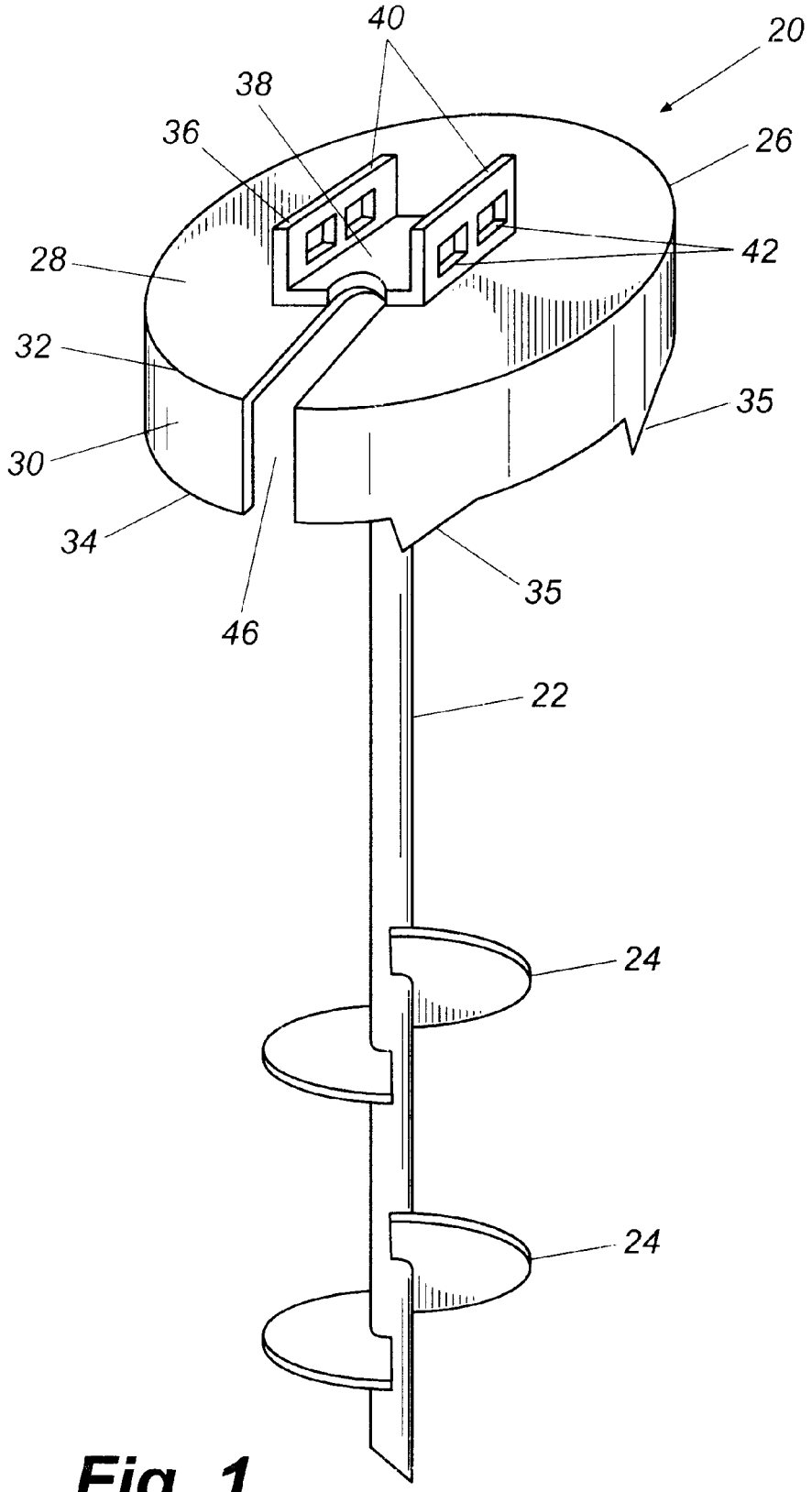
FIG. 1 is a perspective view of the ground anchor with a stabilizer cap, including a series of teeth on the anchor cap skirt and a stacking slot.

A ground anchor 20 with stabilizer cap 26 is shown in FIG. 1. Like the prior art ground anchor of U.S. Pat. No. 4,310,090, At least one auger blade 24 is fixedly attached to the lower end of the anchor shaft 22. The ground anchor 20 is driven into the ground when the helical shaped auger blades 24 cut into the ground as the anchor shaft 22 is rotated by the installation driver (not shown).

In the preferred embodiment illustrated in FIG. 1, the stabilizer cap 26 is fixed to the upper end of the anchor shaft 22 by welding or some equivalent means. The stabilizer cap 26 is approximately circular and aligned concentric with the anchor shaft 22. The stabilizer cap 26 has a flat, disk-shaped top portion 28 and a skirt 30 having a top annular edge 32 and a bottom annular edge 34. The diameters of the stabilizer cap 26, and the associated top portion 28 and the skirt 30, are greater than the diameters of the auger blades 24. Welding or an equivalent means is used to fixedly attach the top annular edge 32 of the skirt 30 to the top portion 28.

As the anchor shaft 22 is rotated and driven into the ground, the affixed stabilizer cap 26 also rotates and engages the ground. Continued rotation of the anchor shaft 22 drives the skirt 30 into the undisturbed ground. To facilitate the insertion of the skirt 30 into the ground, a series of serrated teeth 35 are fixed to the bottom annular edge 34 of the skirt 30 so that the teeth 35 cut into the ground as the skirt 30 and anchor shaft 22 are rotated by the insertion driver. Since the diameter of the approximately circular skirt 30 is greater that the diameter of the auger blades 24, and thereby avoids the loose dirt located in the anchor hole, maximum resistance to lateral forces are provided by the stabilizer cap because the skirt 30 is firmly embedded in the undisturbed soil. This is described in more detail hereinafter.

A winch mount 36 is fixed to the top of the stabilizer cap 26 by welding or some equivalent means. The winch mount 36 is a plate generally U-shaped having a bottom portion 38 and two projecting arms 40. The bottom portion 38 is connected to the top of the stabilizer cap 26 by welding or the like. Two pairs of aligned apertures 42 are formed through the two projecting arms 40 and are adapted to receive a winch (not shown). One end of the tie down strap 62 (See FIG. 4) is connected to the winch using a connection means (not shown) commonly known in the art. The other end of the tie down strap 62 is connected to the premanufactured building. As the winch is turned, slack is removed from the tie down strap 62 and the tie down strap 62 is tightened until the desired tension in the tie down strap 62 is reached. The winch is then locked to maintain tension in the tie down strap 62.

Figure 2:
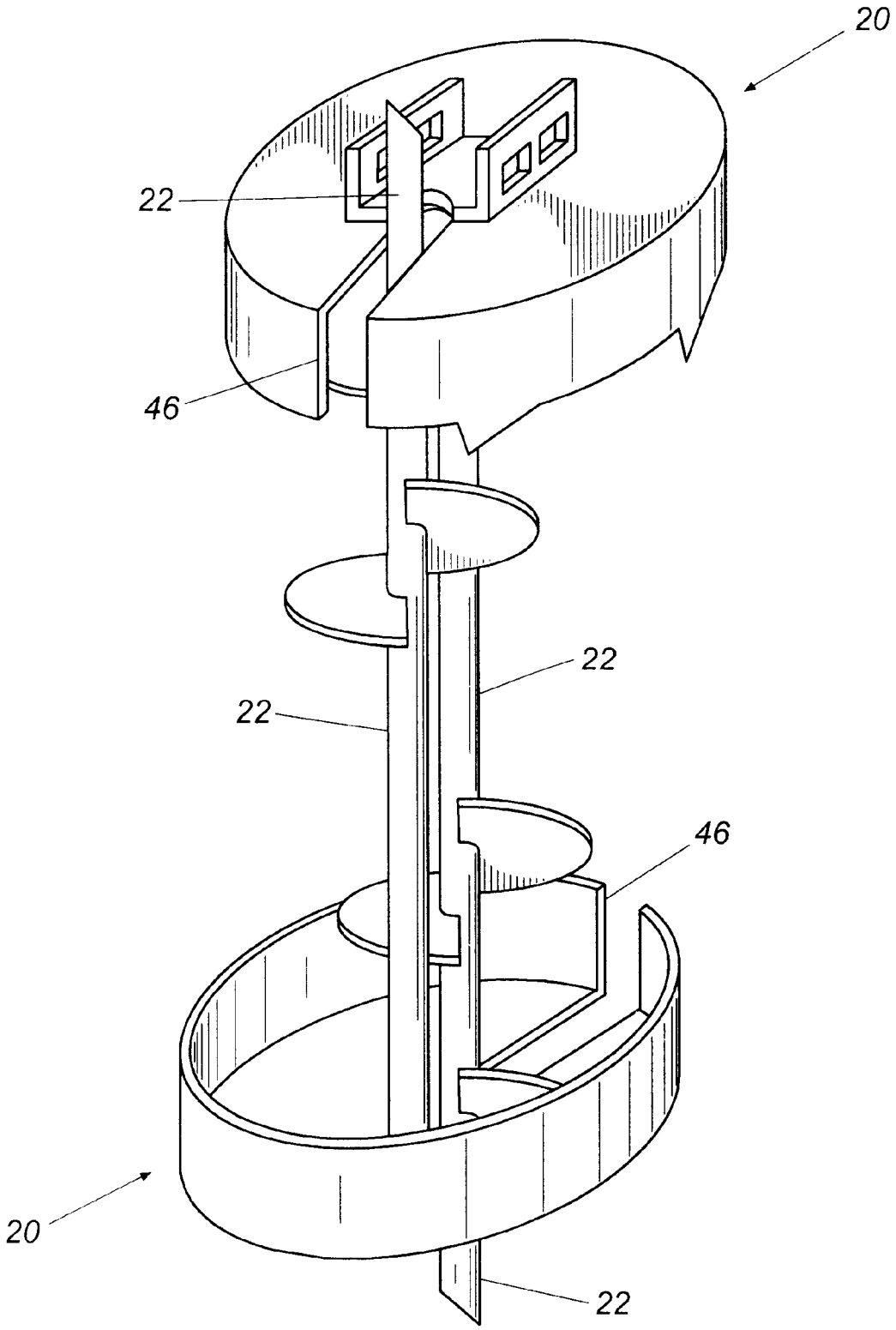
FIG. 2 is a perspective view of the pair of ground anchors of FIG. 1 and illustrates the stacking of the ground anchors in a head-to-toe relationship.

A variation of the preferred embodiment shown in FIG. 2 includes a stacking slot 46 extending from the edge of the skirt 30 to a point sufficiently inside the top portion 28 to receive the anchor shaft 22 of a like ground anchor 20. The width of the stacking slot 46 is slightly larger than the diameter of the anchor shaft 22. Stacking slots 46 provide for the stacking of like ground anchors 20 in a head-to-toe arrangement for packing and transport. Offsetting the winch mount 36 from the central axis of the anchor shaft 22 toward the stacking slot (see also FIG. 4) facilitates stacking of like ground anchors 22 by providing more support to the stabilizer cap 26 at the point of contact with the shaft of the other like ground anchor 20.

Figure 3:
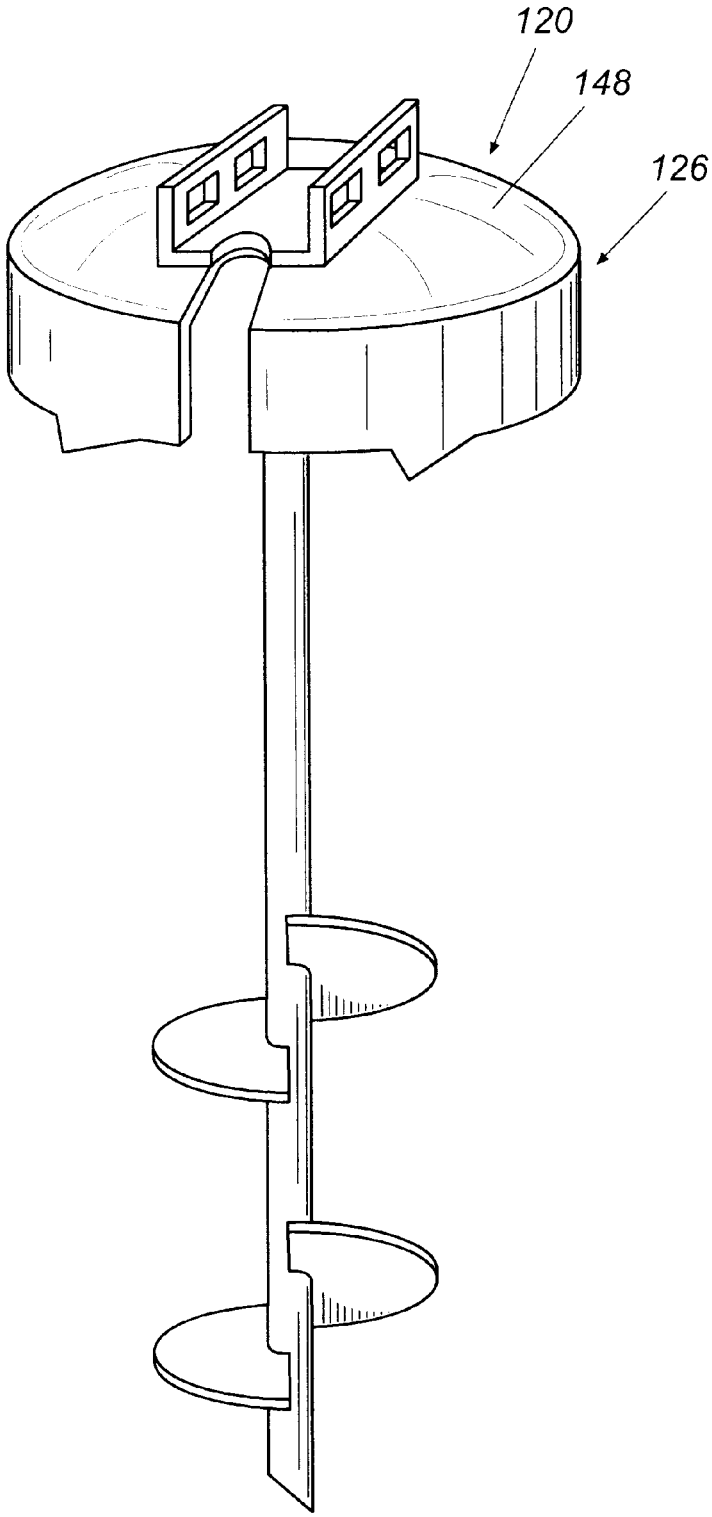
FIG. 3 is a perspective view of a second embodiment of the ground anchor having a domed stabilizer cap.

FIG. 3 shows another embodiment of the ground anchor 120 with stabilizer cap 126. Here, the stabilizer cap 126 top portion 148 is dome shaped, and made of the same elements as the embodiment illustrated in FIG. 1.

Figure 4:
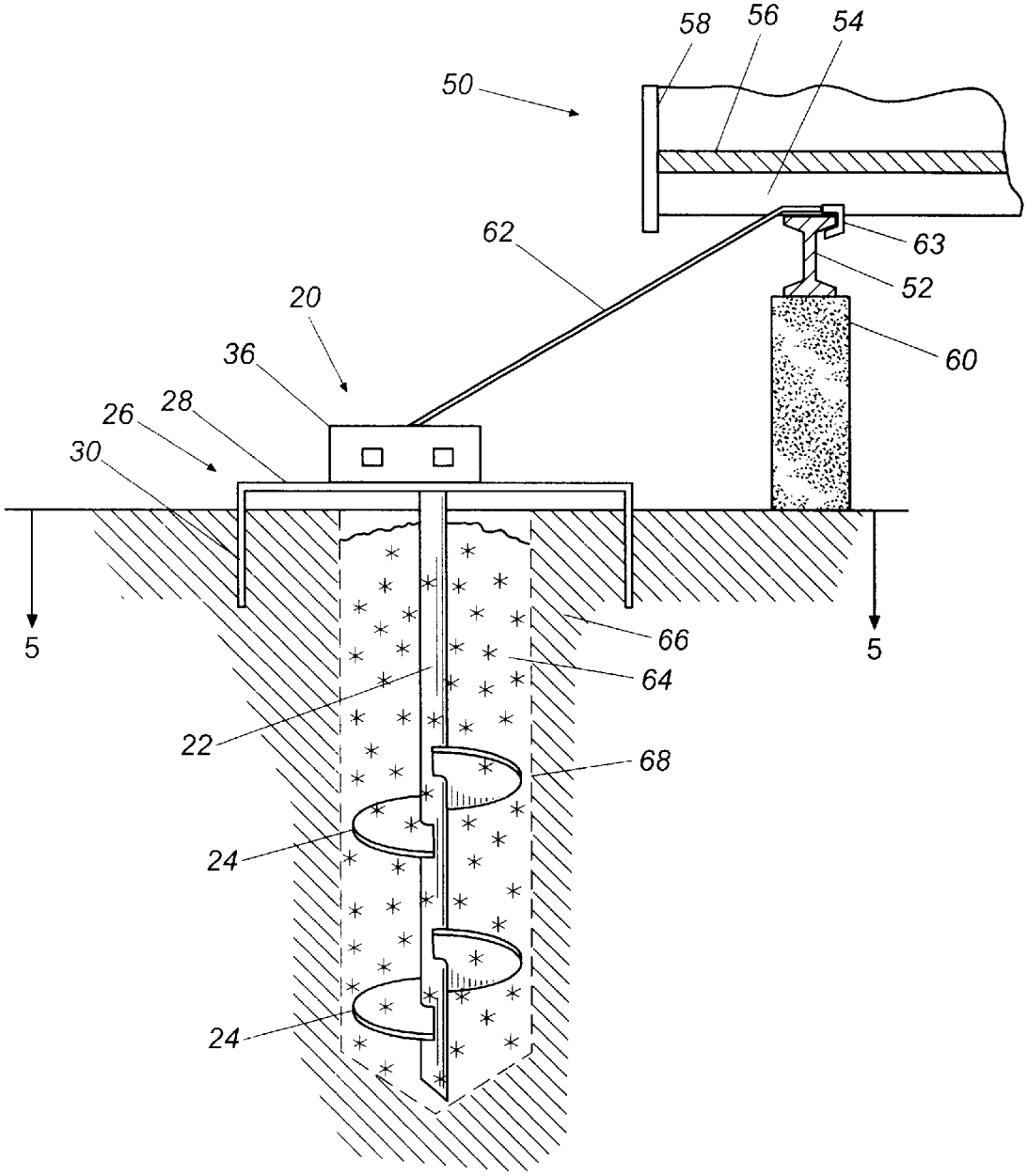
FIG. 4 is a side elevational view of the ground anchor of FIG. 1 illustrating the relative positioning of the ground anchor, the stabilizer cap, the skirt, the undisturbed soil, the column of disturbed soil located in the anchor hole, and a portion of the premanufactured building.

FIG. 4 shows the location of the installed ground anchor 20 with stabilizer cap 26 relative to the premanufactured building 50. A premanufactured building 50 is typically constructed on a series of parallel I-beams 52 made of steel, or the like, running the length of the premanufactured building 50. The I-beams 52 support a plurality of floor joists 54 running perpendicular to the I-beams 52. These floor joists 54 provide support to the premanufactured building 50 floor 56 and the side wall 58 which abuts up to ends of the floor joists 54. Once the premanufactured building 50 has been positioned into the desired location, the premanufactured building 50 is jacked up and the I-beams 52 are placed upon a foundation 60, typically made of concrete support blocks, piers, jacks or other support elements.

After final positioning of the premanufactured building 50 on the foundation 60, a plurality of ground anchors 20 are installed. The number of ground anchors 20 required to adequately secure the premanufactured building 50 is determined by soil conditions, size of the structure, and the expected environmental conditions, such as storms, wind, ground tremors or the like. The ground anchors 20 are typically positioned at the outside of the edge of the premanufactured building 50 side wall 58 as shown in FIG. 4. Here, the tie down strap 62 is shown as connected to the premanufactured building 50 with a U-shaped clip 63 attached to the edge of the I-beam 52.

Figure 5:
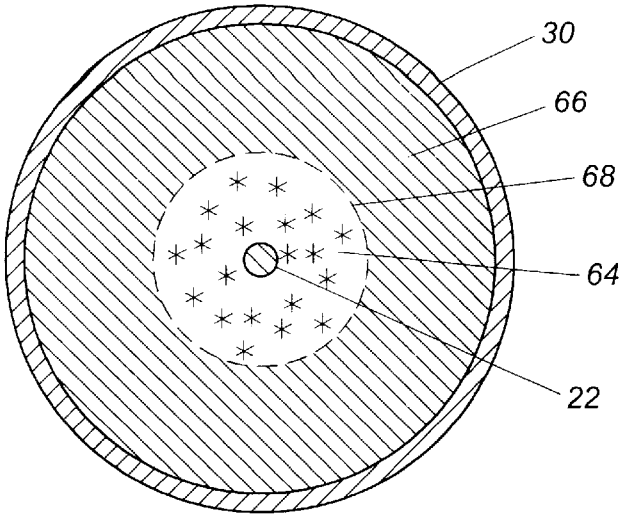
FIG. 5 is a top cross sectional view of an installed ground anchor taken along lines 5—5 of FIG. 4.

FIG. 4 illustrates a side view of the installed ground anchor 20 with stabilizer cap 26. The anchor shaft 22 has been driven into the ground creating a column of disturbed soil 64 by the cutting effect of the auger blades 24. The demarcation between the column of disturbed soil 64, which is loose and provides minimal resistance to lateral forces, and the undisturbed soil 66 is indicated by the anchor hole side wall 68. FIG. 5 is a top view at the ground surface showing the concentric positioning of the anchor shaft 22, column of disturbed soil 64, anchor hole side wall 68, undisturbed soil 66, and the stabilizer cap 26 skirt 30.

Because the diameter of the skirt 30 is larger than the diameter of the auger blades 24, the skirt 30 is firmly embedded in undisturbed soil 66 outside the disturbed soil, as shown in FIG. 4 and FIG. 5. Usually the skirt 30 is not in contact with the loose soil located in the column of disturbed soil 64. Nearly all of the skirt 30 surface embedded in the undisturbed soil 66 is capable of providing a lateral resistive force, as will be described in detail herein.

Figure 6:
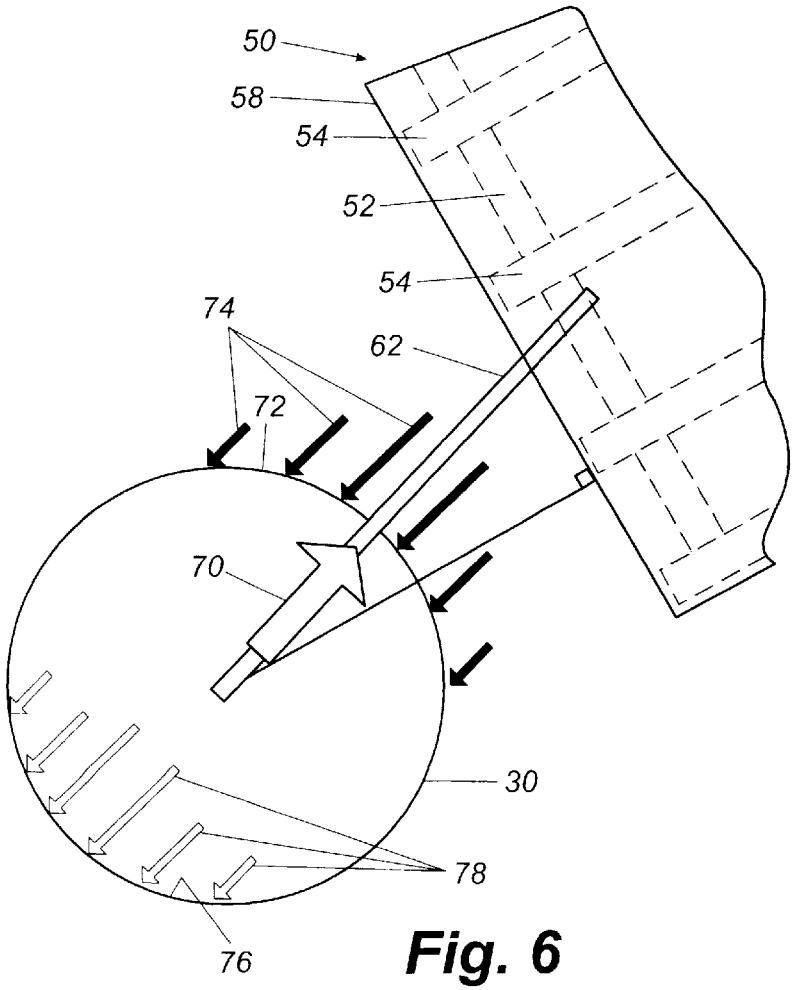
FIG. 6 is a schematic top view of a ground anchor of FIG. 1 illustrating the lateral forces exerted by a tensioned tie down strap upon the ground anchor and the countering lateral forces exerted by the stabilizer cap skirt.

Referencing now to FIG. 6, two surfaces of the skirt 30 are seen which provide resistive forces to the lateral force exerted by the tensioned tie down strap 62, represented by the gray force arrow 70. The first load bearing surface is the outside are of the cylindrical surface 72 of the of the skirt 30, defined as that portion of the skirt wherein lateral resistive forces occur on the outside surface 72 of the skirt 30, as shown by the series of force arrows 74. This outside surface 72 of the skirt 30 is seen to be that half of the skirt 30 which is closest to the point where the tensioned tie down strap 62 is attached to I-beam 52. As commonly understood in the art, the effective load bearing area of the outside surface 72 is calculated to be the skirt 30 diameter times the depth that the skirt 30 is embedded in the soil.

The second load bearing surface is the inside are of the cylindrical surface 76 of the of the skirt 30, defined as that portion of the skirt 30 wherein lateral resistive forces occur on the inside surface 76 of the skirt 30, as shown by the series of white force arrows 78. As illustrated in FIG. 6, this inside surface 76 of the of the skirt 30 is located on that half of the skirt 30 which is farthest from the point where the tensioned tie down strap 62 is attached to I-beam 52. The effective load bearing area of the inside surface 76 is calculated to be the skirt 30 diameter times the depth that the skirt 30 is embedded in the soil. Therefore, the total load bearing surface area of the skirt 30 equals two times the diameter of the skirt 30 times the depth that the skirt 30 is embedded in the soil.

FIG. 6 also demonstrates another feature of the stabilizer plate. As previously discussed, the installer drives the prior art stabilizer plate into the ground before the tie down strap is attached to the premanufactured building. If the stabilizer plate is not normal to the tie down strap, the load bearing cross-sectional area of the stabilizer plate is not maximized. Often, the tie down strap is attached to the premanufactured building wherever the installer can find access to the I-beam.

As illustrated in FIG. 6, the floor joist 54 can prevent the tie down strap from being installed in a location normal to the premanufactured building 50 side wall 58. With the use of the ground anchor 20 with stabilizer cap 26, the substantially circular skirt 30 will provide the maximum load bearing cross-sectional area independent of the final position of the tie down strap 62, as will be apparent to one skilled in the art. Therefore, the installer can be less concerned about finding a position for the ground anchor 20 based upon the available locations for attaching the tie down strap 62 to the I-beam 52. If needed, the positioning of the ground anchor 20 with stabilizer cap 26 can be based upon other factors such as aesthetics, safety, presence of ground obstructions, or landscaping considerations.

Another advance over the prior art stabilizer plate arises because the stabilizer cap 26 is rigidly fixed to the anchor shaft 22. With the prior art stabilizer plate, the prior art anchor shaft flexes and/or bends as the tie down strap 62 is tensioned. When the prior art anchor shaft comes into contact with the prior art stabilizer plate, movement of the anchor shaft is stopped and the stabilizer plate begins to exert resistive forces in opposition to the lateral forces induced by the tensioned tie down strap 62. With the ground anchor 20 with stabilizer cap 26, the stabilizer cap 26 is rigidly fixed to the anchor shaft 22. Therefore, resistive forces are immediately exerted by the skirt 30. There is practically no flexing or bending of the anchor shaft 22.

The simplification of the installation process of the ground anchor 20 with stabilizer cap 26 constitutes a significant advancement over the prior art. The ground anchor 20 with stabilizer cap 26 is installed in one step, as both are simultaneously pulled into position as the installation driver rotates the anchor shaft 22 causing the auger blades 24 to draw the anchor shaft 22 and the stabilizer cap 26 skirt 30 down into the soil.

Other incidental benefits arise from the use of the stabilizer cap 26. The stabilizer cap 26 covers the top portion of the anchor hole side wall 68 preventing erosion damage. Several potential landscaping improvements are offered by the stabilizer cap 26. First, if the ground anchor 20 is installed on a grass lawn, the stabilizer cap 26 provides a means for easy lawn maintenance in that a lawn mower may pass directly over the stabilizer cap 26 and thereby cut the grass growing around the skirt 30 without the need for a separate grass trimming. Or, if decorative rock is used to cover and hide the ground anchor 20, unwanted foliage and/or weeds will not be able to grow around the anchor shaft 22 because the stabilizer cap 26 will act as a root barrier. Finally, the stabilizer cap 26 may be painted a bright warning color to safely warn passers-by of potential danger created by the presence of the ground anchor 20 and the tensioned tie down strap 62.

It should be emphasized that the above-described embodiments of the present invention, particularly, and "preferred" embodiments or configurations, are merely possible examples of implementation, merely set forth for a clear understanding of the principles of the invention. Many variations and modifications may be made to the above-described embodiment(s) of the invention without departing substantially form the spirit and principles of the invention. All such modifications and variations are intended to be included herein within the scope of the present invention.

What is claimed is:

1. A ground anchor for holding above ground objects and the like comprising:

an anchor shaft having a lower end for upright insertion into the ground and an upper end for connecting to an above ground object;

at least one auger blade attached to the lower end of said anchor shaft wherein said auger blade engages the ground and forcibly draws said anchor shaft downwardly into the ground upon rotation of said anchor shaft;

a stabilizer cap being approximately circular, mounted concentric on said anchor shaft and having an outer edge of greater diameter than the diameter of said auger blades, said stabilizer cap being rigidly attached to the upper end of said anchor shaft and extending generally normal to said anchor shaft, such that said stabilizer cap rotates in unison with said anchor shaft;

a cylindrical skirt approximately the same diameter of said stabilizer cap and having an upper annular edge and a lower annular edge, with said upper annular edge of said skirt rigidly attached to said outer edge of said stabilized cap;

said stabilizer cap including a stacking slot extending through said stabilizer cap and said cylindrical skirt such that said stacking slot is sized and shaped to receive the anchor shaft of a duplicate one of said ground anchor for stacking said ground anchors for storage and transport;

a winch mount connected to said ground anchor above said stabilizer cap for connecting said ground anchor to an above ground object, whereby lateral support to said anchor shaft is provided by said skirt as said skirt engages and enters into the undisturbed ground outside the hole made in the ground by said auger blades as said anchor shaft is drawn into the ground.

2. The ground anchor of claim 1, wherein said stabilizer cap is approximately disk shaped.

3. The ground anchor of claim 1, wherein said stabilizer cap is approximately dome shaped.

4. The ground anchor of claim 1, further comprising a series of teeth attached said lower annular edge of said skirt so that said series of teeth engage and penetrate the ground as said ground anchor is rotated and drawn into the ground.

5. The ground anchor of claim 1, wherein said stabilizer cap diameter is at least approximately one and one-half times the diameter of said auger blades.

* * * * *